US011076476B2

(12) United States Patent
Sublemontier et al.

(10) Patent No.: US 11,076,476 B2
(45) Date of Patent: Jul. 27, 2021

(54) PROCESS FOR CONTROLLING, UNDER VOID, A JET OF PARTICLES WITH AN AERODYNAMIC LENS AND ASSOCIATED AERODYNAMIC LENS

(71) Applicant: Commissariat A L'energie Atomique Et Aux Energies Alternatives, Paris (FR)

(72) Inventors: Olivier Sublemontier, Fontenay-aux-Roses (FR); Youri Rousseau, Limours (FR)

(73) Assignee: Commissariat A L'energie Atomique Et Aux Energies Alternatives, Paris (FR)

( * ) Notice: Subject to any disclaimer, the term of this patent is extended or adjusted under 35 U.S.C. 154(b) by 0 days.

(21) Appl. No.: 15/381,542

(22) Filed: Dec. 16, 2016

(65) Prior Publication Data

US 2017/0181262 A1 Jun. 22, 2017

(30) Foreign Application Priority Data

Dec. 18, 2015 (FR) ..... 15 62865

(51) Int. Cl.
*H05H 3/00* (2006.01)
*C23C 24/04* (2006.01)
*B05B 1/30* (2006.01)

(52) U.S. Cl.
CPC ..... *H05H 3/00* (2013.01); *B05B 1/3026* (2013.01); *C23C 24/04* (2013.01)

(58) Field of Classification Search
CPC . B82Y 40/00; H05H 1/24; H05H 3/00; H05H 3/02; H05G 2/006; H05G 2/008
(Continued)

(56) References Cited

U.S. PATENT DOCUMENTS 5,565,677 A * 10/1996 Wexler ..... F15D 1/02 250/251
2004/0046130 A1* 3/2004 Rao ..... C04B 35/565 250/492.1

(Continued)

FOREIGN PATENT DOCUMENTS

FR 2 971 518 A1 8/2012
FR 2 994 443 A1 2/2014

(Continued)

OTHER PUBLICATIONS

Search Report for French Application No. FR 15 62865 dated Aug. 25, 2016.

(Continued)

*Primary Examiner* — Alexander M Weddle
(74) *Attorney, Agent, or Firm* — Alston & Bird LLP

(57) ABSTRACT

The invention relates to a method for controlling the divergence of a jet of particles in vacuo with an aerodynamic lens, the aerodynamic lens including at least one chamber; a diaphragm, a so-called inlet diaphragm, intended to form an inlet of the aerodynamic lens for a jet of particles, the inlet diaphragm having a given diameter ($d_1$); and another diaphragm, a so-called outlet diaphragm, intended to form an outlet of the aerodynamic lens for this jet of particles; the method including: a step for generating the jet of particles from the inlet to the outlet, in vacuo, of the aerodynamic lens; and a step for adjusting the diameter ($d_s$) of the outlet diaphragm for controlling the divergence of the jet of particles.

19 Claims, 6 Drawing Sheets

(58) Field of Classification Search
USPC ..... 427/180
See application file for complete search history.

(56) References Cited

U.S. PATENT DOCUMENTS

| | | | | |
|---|---|---|---|---|
| 2005/0230614 | A1* | 10/2005 | Glukhoy | H01J 49/0022 250/287 |
| 2006/0102837 | A1* | 5/2006 | Wang | G01N 1/2208 250/288 |
| 2011/0186167 | A1* | 8/2011 | Lee | F24H 9/12 138/37 |
| 2014/0044886 | A1* | 2/2014 | Sublemontier | C23C 14/06 427/535 |
| 2017/0131129 | A1* | 5/2017 | Ahr | H05G 2/006 |
| 2017/0181262 | A1* | 6/2017 | Sublemontier | H05H 3/00 |

FOREIGN PATENT DOCUMENTS

| | | | |
|---|---|---|---|
| KR | 101 465 363 | B1 | 11/2014 |
| KR | 101465363 | B1 * | 11/2014 |
| KR | 2015 0115995 | A | 10/2015 |
| WO | WO 02/05969 | A2 | 1/2002 |

OTHER PUBLICATIONS

Liu et al., *Generating Particles Beams of Controlled Dimensions and Divergence: II. Experimental Evaluation of Particle Motion in Aerodynamic Lenses and Nozzle Expansions*, Aerosol. Sci. Technolg. 1995, vol. 22, pp. 314-324.

* cited by examiner

Fig.1
(Prior art)
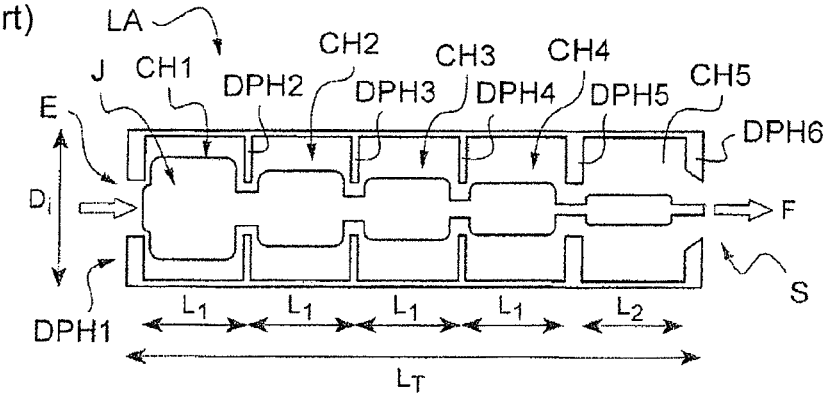
Fig.2
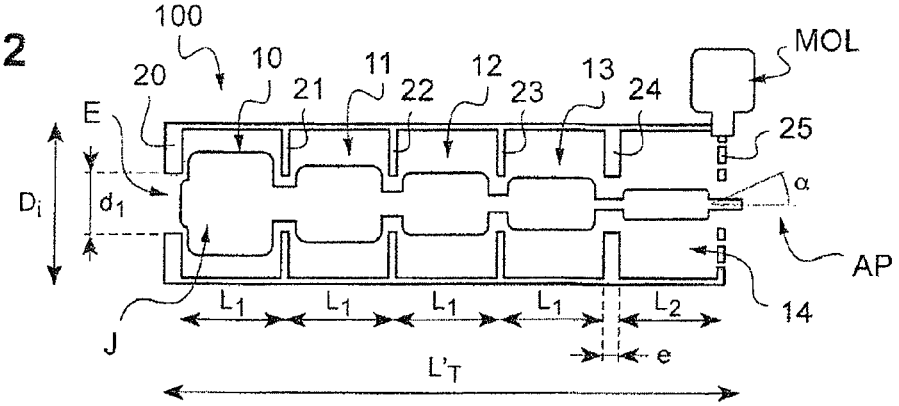
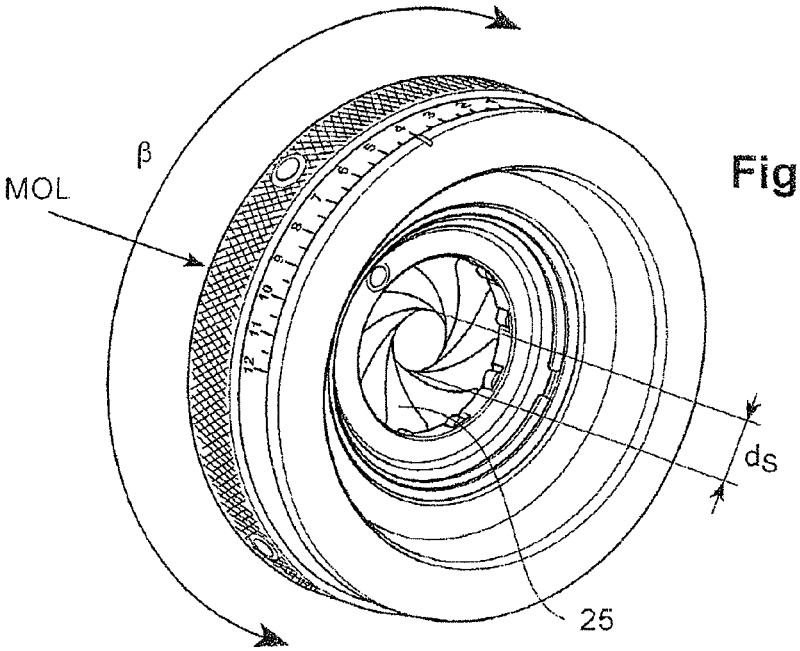
Fig.3

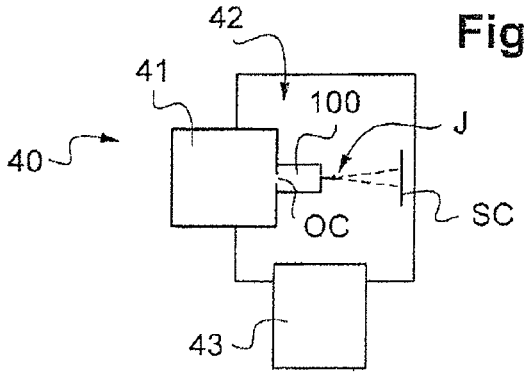
Fig.4
Fig.5(a)
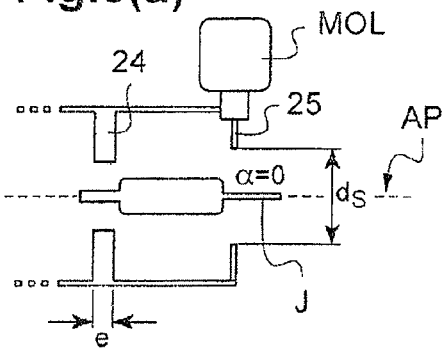
Fig.5(b)
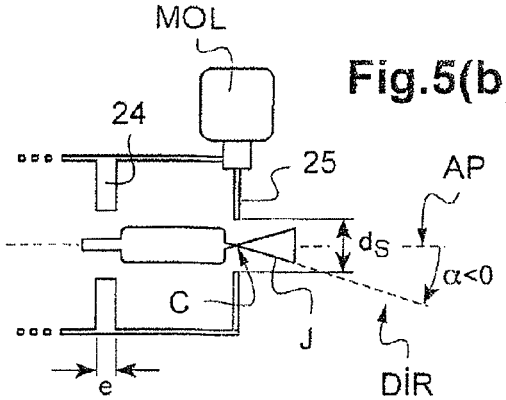
Fig.5(c)
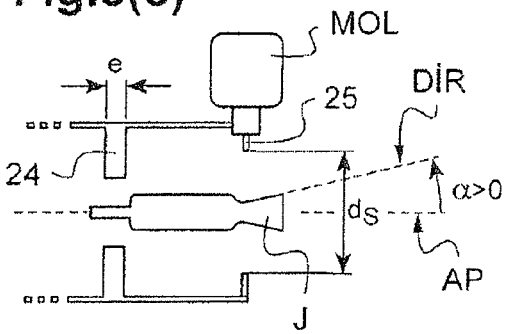
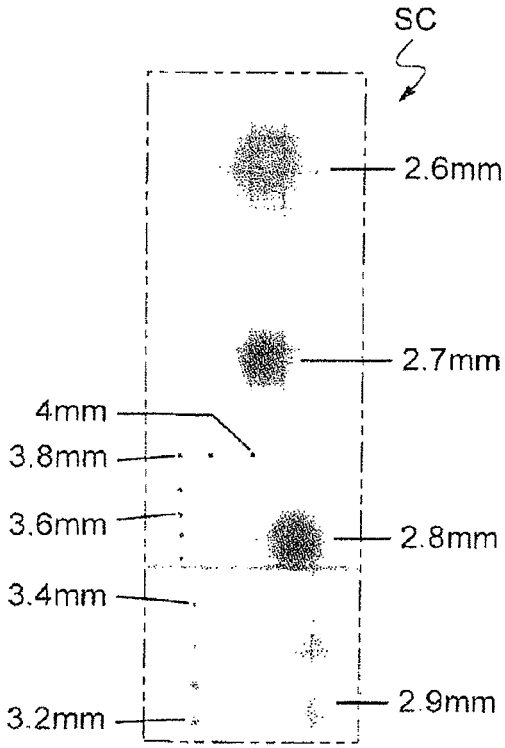
Fig.6

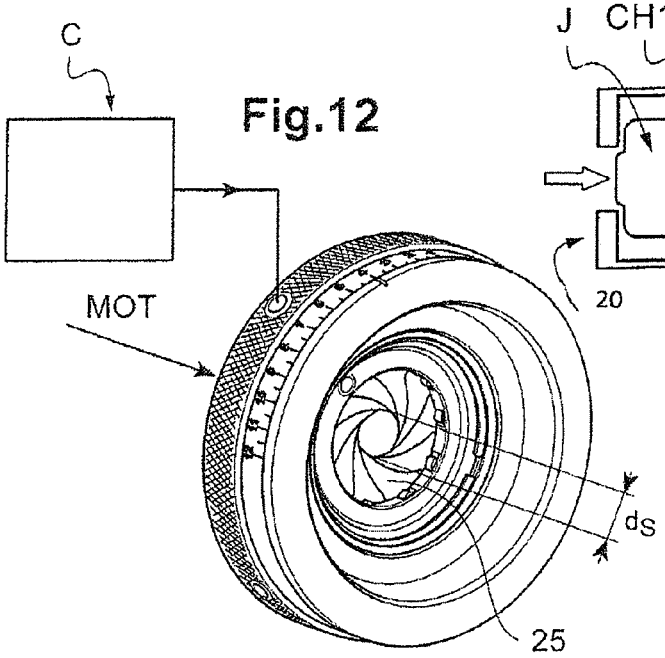
Fig.12
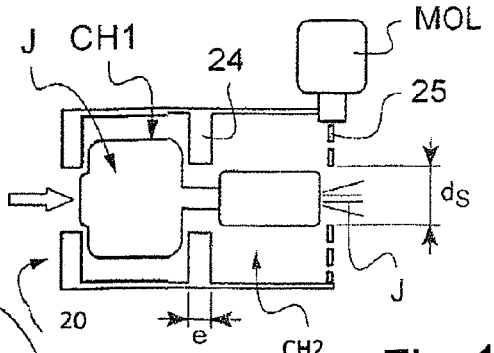
Fig. 11
Fig.13
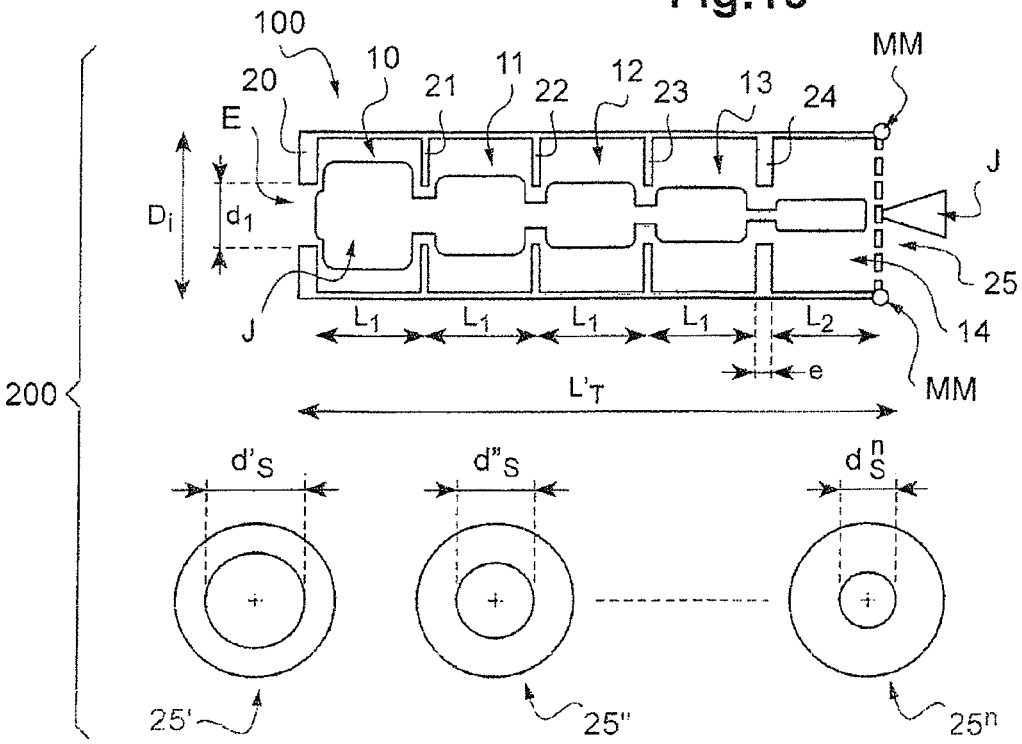

PROCESS FOR CONTROLLING, UNDER VOID, A JET OF PARTICLES WITH AN AERODYNAMIC LENS AND ASSOCIATED AERODYNAMIC LENS

FIELD

The invention relates to the field of aerodynamic lenses.

An aerodynamic lens is used for generating a jet of particles, notably nanoparticles, in vacuo.

BACKGROUND

The generation of this jet of particles may be used for achieving deposition of these particles in vacuo, on a target surface. In this case, the aerodynamic lens is for example coupled with a vacuum physical deposition device, including the target surface. Reference may for example be made to documents FR 2 971 518 and FR 2 994 443.

The main advantage of an aerodynamic lens is obtaining, at the outlet of the latter, a collimated particle jet in vacuo. A collimated particle jet is a particularly narrow jet, therefore not very divergent and dense and which moreover is capable of retaining these properties over a long distance in vacuo. These properties are advantageous for achieving a deposition of these particles, in vacuo, on a target surface.

FIG. 1 illustrates a known aerodynamic lens (Liu & al., "Generating particles Beams of Controlled Dimensions and Divergence: II. Experimental Evaluation of Particle Motion in Aerodynamic Lenses and Nozzle Expansions", Aerosol. Sci. Technolg., 1995, Vol. 22, pp. 314-324), particularly well adapted for obtaining a jet of particles, notably of nanoparticles, collimated at the outlet of this lens.

This aerodynamic lens LA has a cylindrical shape, the external diameter of which is of about 10 mm (internal diameter Di=10 mm, to which should be added the wall thicknesses of the aerodynamic lens in order to be exact) and the total length $L_T$ of about 300 mm.

It comprises several chambers and several diaphragms, in this case five chambers CH1, CH2, CH3, CH4 and CH5 and six DPH1 diaphragms (inlet E of the aerodynamic lens defined by the direction F of flow of the jet of particles, upon use), DPH2, DPH3, DPH4, DPH5 and DPH6 (outlet S of the aerodynamic lens).

The diaphragms DPH1, DPH2, DPH3, DPH4, DPH5 all have an orifice for letting through the jet of particles which has a shape of a regular cylinder, therefore with a constant circular section. However, the diameter of each diaphragm (=diameter of each orifice) decreases from the inlet E to the outlet S of the aerodynamic lens. More specifically, the diameter of the diaphragm DPH1 has the value 5 mm, that of the diaphragm DPH2 has the value of 4.75 mm, that of the diaphragm DPH3 has the value 4.5 mm, that of the diaphragm DPH4 has the value of 4.25 mm and that of the diaphragm DPH5 has the value of 4 mm.

As to the diaphragm DPH6, it has an orifice with a frustoconical shape, therefore a circular section for which the diameter changes according to its thickness, its diameter being greater at its inlet than at its outlet (convergent shape along the direction F of flow of the jet of particles), an outlet which coincides with that of the aerodynamic lens. The diameter of the diaphragm DPH6, at the outlet S of the aerodynamic lens is less than that of the other diaphragms, and in particular that of the diaphragm DPH5, and has the value 3 mm.

The diaphragms DPH1, DPH5 and DPH6 have a thickness of 10 mm (they may also be assimilated with tubes).

The diaphragms DPH2, DPH3 and DPH4 have a thickness which does not exceed one millimeter.

All the chambers are cylindrical and have an identical diameter Di, of 10 mm each. The chambers CH1 to CH4 all have a same length L1, of 50 mm, and the last chamber CH5 has a length L2, greater than the length L1, of 65 mm.

Upon use, particles in a carrier gas are first of all provided with a means, for example with an aerosol generator, known to one skilled in the art.

A pressure difference is maintained between the inlet E and the outlet S of the aerodynamic lens LA, the outlet S being in vacuo (0.1 mbars, for example). Typically, the pressure at the inlet E of the aerodynamic lens is of a few mbars. This pressure difference then gives the possibility of generating the jet J of particles in vacuo from particles in the carrier gas at the inlet of the aerodynamic lens. More specifically, under the effect of this pressure difference, the particles in the carrier gas are caused to form a jet of particles successively passing into the different chambers CH1 to CH5, through the different diaphragms DPH1 to DPH6. At each passage through a diaphragm, the jet of particles is a little more collimated.

It should be noted that the capability of an aerodynamic lens of achieving a collimated jet of particles depends on the type of particles which one seeks to collimate, and more specifically on their size and on their density.

Further, obtaining a collimated jet is not the only design constraint.

Indeed, the aerodynamic lens should have significant transmission. The transmission of an aerodynamic lens represents the ratio between the number of particles emerging from the lens over the number of particles entering into this lens. It is sometimes expressed as a percentage.

Upon passing of the jet of particles through a diaphragm, certain particles will impact the walls of the diaphragm and are therefore not transmitted towards the next chamber.

For this reason, it is preferable to provide several chambers which allow stepwise collimation. In FIG. 1, the diaphragms have increasingly small diameters from the inlet of the aerodynamic lens to the outlet of this lens. However, this is not necessarily the case.

Moreover, the transmission, just like the collimation, depends on the type of particles and more particularly on their diameter and on their density (or specific gravity, which amounts to the same).

Thus, in the case of particles with a too large size and/or too dense, the particles may have difficulties in following the changes in direction of the flow of the carrier gas. This capability of the particles of the jet of following the flow of the carrier gas is more generally defined by the Stokes number (a dimensionless number, theory of similarity).

The Stokes number is defined by the following relationship:

$$St = \frac{\rho_p v d_p^2}{\mu L_c}$$

Wherein:

$\rho_p$ is the specific gravity of a particle, $d_p$ is the size of a particle, v is the speed of the carrier gas, μ is the dynamic viscosity of the carrier gas, and $L_c$ is a characteristic length.

This characteristic length $L_c$ is to be adapted depending on the relevant case. For example, if the aerodynamic lens illustrated in FIG. 1 is considered, this characteristic length may be selected as being the difference between the internal radius Ri of the aerodynamic lens (Ri=Di/2=5 mm) from which is removed the average radius Rm of the different diaphragms (Rm=(5+4.75+4.5+4.25+4+3)/(6*2)=2 mm), i.e. $L_c$=Ri−Rm≅3 mm. Another selection may be made for defining this characteristic length.

Thus, if the Stokes number is too high (particles with too large sizes and/or too dense, for example), the particles cannot follow the changes in direction of the carrier gas upon passing a diaphragm (inertia) and will impact the wall of a diaphragm, which is expressed by a transmission loss.

Moreover, in the case of not very dense particles and/or of small sizes, and even if accordingly the Stokes number is small and that the particles may, aerodynamically, follow the changes in direction of the carrier gas upon passing a diaphragm, the existence of a Brownian motion limits the transmission through a diaphragm.

Thus, the aerodynamic lens illustrated in FIG. 1, which is particularly performing, gives the possibility of collimating particles by forming a jet, the diameter of which is less than 1 mm and a transmission close to one unit (100%), for a particle size comprised between 70 nm and 500 nm.

More generally, an aerodynamic lens generally gives the possibility of obtaining good collimation of the particles with acceptable transmission, for particles for which the size is comprised between 50 nm and 1 micron.

Indeed, an aerodynamic lens is dimensioned for collimating as much as possible the jet of particles at the output of the lens, therefore for limiting as much as possible the divergence of the jet of particles at this outlet, with a transmission as high as possible.

This then implies, considering the constraints recalled earlier, the definition of a range for the size of particles which gives the possibility of attaining this goal.

With this purpose, different aerodynamic lenses have already been proposed from the one which is illustrated in FIG. 1.

Thus, depending on the size of the targeted particles, while retaining quality collimation and transmission, a number of chambers may be provided, and therefore of diaphragms, different from what is illustrated in FIG. 1.

It is further possible to adapt the geometry of the different chambers (diameter, length of each chamber) and/or those of the different diaphragms.

The design of the aerodynamic lens is therefore defined and set on this basis and this design gives the possibility of applying a method for generating a jet of particles as collimated as possible, i.e. not very divergent as possible.

For application to the vacuum deposition of the particles on a target surface, this gives the possibility of obtaining a narrow deposit, with a Lorentzien profile, on a surface of a small dimension (typically less than 1 $mm^2$).

SUMMARY

A goal of the invention is to propose a method for generating a jet of particles in vacuo, based on the use of an aerodynamic lens, according to an approach different from the prior art.

Indeed, the applicants realized that it was conceivable to control the divergence of the jet of particles at the outlet of the aerodynamic lens.

The invention therefore proposes a method for controlling the divergence of a jet of particles in vacuo with an aerodynamic lens, said aerodynamic lens comprising:

- n chambers, with n≥2, said chambers being separated from each other by a non-removable diaphragm and having a given diameter, which cannot be adjusted;
- a diaphragm, a so-called inlet diaphragm, intended to form an inlet of the aerodynamic lens for a jet of particles, said inlet diaphragm having a given diameter; and
- another diaphragm, a so-called outlet diaphragm, intended to form an output of the aerodynamic lens for this jet of particles, said outlet diaphragm having an adjustable diameter;

said method including:

- a step for generating the jet of particles from the inlet to the outlet, in vacuo, of the aerodynamic lens; and
- a step for adjusting the diameter of the outlet diaphragm in order to control the divergence of the jet of particles.

This method may also comprise the following features, taken alone or as a combination:

- the diameter of the outlet diaphragm is adjusted in a range of values strictly less than the diameter of the inlet diaphragm;
- the aerodynamic lens includes n chambers, with n≥3, and therefore n diaphragms other than the outlet diaphragm, two successive chambers being separated from each other by a non-removable diaphragm and having a given diameter which is not adjustable;
- the inlet diaphragm is non-removable and has a diameter which is not adjustable;
- the diameter of the outlet diaphragm is adjusted to a value strictly smaller than the diameters of said n diaphragms other than the outlet diaphragm;
- the pressure at the inlet of the aerodynamic lens is comprised between 2 mbars and 5 mbars, preferably between 3 mbars and 5 mbars.

The possibility of controlling the divergence of the jet of particles at the outlet of an aerodynamic lens according to the applicant has not been reported to this day in the prior art. This is moreover consistent with the fact that the designers of aerodynamic lenses have always sought to obtain a jet of particles as collimated as possible, i.e. the less divergent as possible.

The invention therefore also proposes an aerodynamic lens for applying a method according to the invention, comprising:

- n chambers, with n≥2, said chambers being separated from each other by a non-removable diaphragm and having a given diameter which is not adjustable;
- a diaphragm, a so-called inlet diaphragm, intended to form an inlet of the aerodynamic lens for a jet of particles, said inlet diaphragm having a given diameter; and
- another diaphragm, a so-called outlet diaphragm, intended to form an outlet of the aerodynamic lens for this jet of particles;

characterized in that the outlet diaphragm has an adjustable diameter.

This aerodynamic lens may include at least one of the following features, taken alone or as a combination:

- it includes n chambers, with n≥3, and therefore n diaphragms other than the outlet diaphragm, two successive chambers being separated from each other by a non-removable diaphragm and having a given diameter which is not adjustable;
- the number n of chambers and therefore of diaphragms other than the outlet diaphragm is such that n≥5 and, for example, such as n≤15, two successive chambers being separated from each other by a non-removable diaphragm and having a given diameter, which is not adjustable;

the inlet diaphragm is non-removable and has a diameter which is not adjustable;

the outlet diaphragm appears as an iris which may be actuated manually;

the outlet diaphragm appears as an iris, the diameter of which is adjustable by a controlled motor;

the inlet diaphragm of the chamber including said outlet diaphragm of the aerodynamic lens has a thickness comprised between 0.2 mm and 5 mm.

Alternatively, the invention also proposes an assembly for applying a method according to the invention, including an aerodynamic lens comprising:

n chambers, with n≥2, said chambers being separated from each other by a non-removable diaphragm and having a given diameter which is not adjustable;

a diaphragm, a so-called inlet diaphragm, intended to form an inlet of the aerodynamic lens for a jet of particles, said inlet diaphragm having a given diameter; and another diaphragm, a so-called outlet diaphragm, intended to form an outlet of the aerodynamic lens for this jet of particles, said outlet diaphragm having a given diameter;

characterized in that the outlet diaphragm is removably mounted within the aerodynamic lens and in that said assembly further comprises at least one additional diaphragm having a diameter different from that of the outlet diaphragm, said at least one additional diaphragm being intended to be removably mounted in the aerodynamic lens instead and in the place of said outlet diaphragm.

This assembly may include at least one of the following features, taken alone or as a combination:

the aerodynamic lens includes n chambers, with n≥3, and therefore n diaphragms other than the outlet diaphragm, two successive chambers being separated from each other by a non-removable diaphragm and having a given diameter, which is not adjustable;

the number n of chambers and therefore of diaphragms other than the outlet diaphragm is such that n≥5 and, for example such as n≤15, two successive chambers being separated from each other by a non-removable diaphragm and having a given diameter, which is not adjustable;

the inlet diaphragm is non-removable and has a diameter which is not adjustable;

the inlet diaphragm of the chamber including said outlet diaphragm of the aerodynamic lens has a thickness comprised between 0.2 mm and 5 mm.

Incidentally, the fact of being able to control the divergence of the jet of particles at the outlet of the aerodynamic lens is particularly advantageous for application to the deposition in vacuo of the particles on a target surface of a large size (for example greater than 1 $cm^2$). Indeed, this control finally gives the possibility of adjusting the extent of the deposition surface of the particles on the target surface, while allowing a homogeneous deposit on this target surface.

The invention therefore finally proposes the use of an aerodynamic lens as described earlier or of an assembly as described earlier for depositing, in vacuo, particles on a target surface.

The target surface may have a surface area greater than or equal to one $cm^2$.

BRIEF DESCRIPTION OF THE DRAWINGS

Other objects and advantages of the invention will be described hereafter, as support for the appended figures wherein:

FIG. 1 illustrates an example prior art aerodynamic lens;

FIG. 2 illustrates an aerodynamic lens which may be used for applying the method according to the invention;

FIG. 3 illustrates a possible embodiment of a diaphragm used at the outlet of the aerodynamic lens illustrated in FIG. 2;

FIG. 4 is a representative diagram of a complete assembly for applying the method according to the invention;

FIG. 5, which comprises FIGS. 5(*a*) to 5(*c*), illustrates the different shapes of the jet of particles which may be obtained at the outlet of the aerodynamic lens of FIG. 2;

FIG. 6 provides experimental results;

FIG. 11 shows another aerodynamic lens which may be used for applying the method according to the invention;

FIG. 12 illustrates another aerodynamic lens which may be used for applying the method according to the invention, and wherein the diaphragm includes a motor which may be controlled by a controller;

FIG. 13 illustrates an assembly which may be used for applying the method according to the invention, including an aerodynamic lens, the outlet diaphragm of which is removable and a set of diaphragms.

DETAILED DESCRIPTION

Figure 7A:
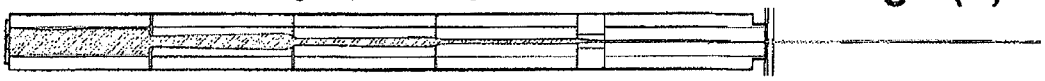
FIG. 7, which comprises FIGS. 7(*a*) to 7(*c*), provides simulation results for conditions of a collimated particle jet.

The method according to the invention is a method for controlling the divergence of a jet of particles in vacuo with an aerodynamic lens, said aerodynamic lens comprising:

n chambers, with n≥2, said chambers being separated from each other by a non-removable diaphragm and having a given diameter, which is not adjustable;

a diaphragm, a so-called inlet diaphragm, intended to form an inlet of the aerodynamic lens for a jet of particles, said inlet diaphragm having a given diameter; and another diaphragm, a so-called outlet diaphragm, intended to form an outlet of the aerodynamic lens for this jet of particles, said outlet diaphragm having an adjustable diameter;

said method including a step for generating the jet of particles from the inlet to the outlet, in vacuo, of the aerodynamic lens; and a step for adjusting the diameter of the outlet diaphragm in order to control the divergence of the jet of particles.

It will be noted that it is customary, in the field of aerodynamic lenses, of assimilating a diaphragm to a membrane or wall including an orifice. Moreover, when one refers to the diameter of the diaphragm, one also usually refers to the diameter of the orifice and not to the diameter of the membrane or wall which includes this orifice.

This is valid for the whole of the description of the invention which will follow, like for the prior art described for supporting FIG. 1.

FIG. 2 illustrates an aerodynamic lens 100 which may be used for applying this method.

This aerodynamic lens 100 comprises a plurality of chambers 10, 11, 12, 13, 14, a diaphragm, a so-called inlet diaphragm 20, intended to form an inlet of the aerodynamic lens for a jet of particles, said inlet diaphragm having a given diameter d1 and another diaphragm, a so-called outlet diaphragm 25, intended to form an outlet of the aerodynamic lens for this jet of particles.

In the present case, the inlet diaphragm is non-removable and has a diameter which is not adjustable.

The aerodynamic lens also comprises other diaphragms 21, 22, 23, 24 separating two chambers in succession. Each diaphragm 21, 22, 23, 24 (other than the outlet diaphragm 25) is a non-removable diaphragm and having a given diameter, which is not adjustable.

More generally, the aerodynamic lens 100 of FIG. 2 is a lens according to that of FIG. 1, except for the outlet diaphragm 25.

However, within the scope of the invention, the outlet diaphragm 25 has an adjustable diameter $d_s$, which is not the case in the prior art.

It is this adjustment, carried out at the outlet diaphragm 25, which gives the possibility of controlling the divergence of the jet of particles, in vacuo, at the outlet of the aerodynamic lens.

Moreover, the adjustment of the diameter of the outlet diaphragm 25 may be carried out so that its diameter is less than or not to the diameter of the diaphragms 20 to 24.

FIG. 3 illustrates a practical embodiment which may be contemplated for obtaining an outlet diaphragm 25 for which the diameter is adjustable.

In this case, this is an iris-shaped diaphragm 25 that is actuatable manually. The rotation (angle β) gives the possibility of adjusting the diameter $d_s$ of the outlet diaphragm 25. This is the adjustment of the diameter $d_s$ which finally allows control of the divergence of the jet of particles at the outlet of the aerodynamic lens 100, as this will be shown subsequently. In practice, the outlet diaphragm 25 is then mounted inside the aerodynamic lens 100 and the curl MOL is located outside this lens so as to be accessible by an operator. It is understood that the object (MOL+25) of FIG. 3 therefore belongs to the aerodynamic lens 100.

Of course, in order to apply the method according to the invention, a means 40 should be provided for generating the particles in a carrier gas, which will allow, by differential pressurization between the outlet S of the aerodynamic lens 100 and the inlet E of this aerodynamic lens 100, generation of the jet of particles.

FIG. 4 is a representative diagram of a possible assembly for this purpose.

This means 40 comprises a tank 41 which contains a mixture of carrier gas and of particles suspended in a gas. The pressure and the temperature of the gas as well as the concentration of nanoparticles in this gas are adjustable. The tank 41 may be a synthesis reactor for example operating by laser pyrolysis, laser ablation, evaporation in vacuo, combustion or be a generator of particles via a plasma. This may also be a generator of aerosols formed from a suspension of particles in a liquid, elaborated in advance or from a dry nanometric powder. It is possible to adapt the pressure in the tank 41 to that of the inlet of the aerodynamic lens by means of a critical diaphragm or orifice OC. For example it is possible to have a tank 41 at atmospheric pressure and a pressure of a few millibars at the inlet of the aerodynamic lens by placing a diaphragm with a diameter of a few hundred micrometers between the tank and the aerodynamic lens.

This means 40 also comprises an expansion chamber 42, in vacuo (0.1 mbars for example), into which the carrier gas containing the particles is introduced from the tank 41. The pressure in the expansion chamber 42 is less than the pressure of the tank 41. Application of a vacuum to the expansion chamber is ensured by a pumping means 43. Passing from the tank 41 to the expansion chamber 42 is carried out via the aerodynamic lens 100, illustrated in FIG. 2.

In this FIG. 4, the presence of a target surface SC for the particles is also noted.

FIG. 5, which comprises FIGS. 5(*a*) to 5(*c*), illustrates three possible adjustment cases of the diameter $d_s$ of the outlet diaphragm 25.

In FIG. 5(*a*), the adjustment is carried out so as to have d=3 mm for example. This is a conventional situation wherein the diameter of the outlet diaphragm is strictly less than that of the assembly of the other diaphragms 20 to 24 and the Stokes number is close to one, therefore the transmission is also close to one. The jet of particles is then collimated at the outlet of the aerodynamic lens.

In FIG. 5(*b*), the adjustment is carried out so as to have d=2.4 mm. There also, this is a situation wherein the diameter of the outlet diaphragm 25 is strictly less than that of the assembly of the other diaphragms 20 to 24. However, the Stokes number is forced to a value greater than one, typically between 2.5 and 3 in order to force the jet of particles to be rapidly focused at the outlet of the aerodynamic lens and obtaining a divergent jet. In this case, this situation results in obtaining a half-angle, called α, of a so-called "negative" divergence (the trajectories cross on the propagation axis AP of the aerodynamic lens, the crossing point being noted as C in FIG. 5(*b*)). This situation is not conventional.

The divergence half-angle α is defined by the angle formed between the propagation axis AP of the aerodynamic lens and the direction DIR given by the shape of the jet.

In FIG. 5(*c*), the adjustment is carried out so as to have d=6 mm. In this case, the diameter of the outlet diaphragm 25 is strictly greater than that of the whole of the diameters of the diaphragms 20 to 24. Moreover, the Stokes number is then forced to a value substantially less than one, which has the consequence of not concentrating the jet of particles on the optical axis of the jet. The jet of particles is then divergent, but with a divergence half-angle α which is "positive" (the trajectories do not cross on the propagation axis AP of the aerodynamic lens). This situation is not conventional.

The different situations were able to be shown with experimental tests applying a chamber, in vacuo, including a target surface and coupled with the aerodynamic lens of FIG. 2.

Particles in a carrier gas (aerosol) are generated with a conventional device located upstream from the aerodynamic lens. In this case, the carrier gas is argon. The pressure is of 4 mbars at the inlet of the aerodynamic lens and in a vacuum (0.1 mbars, for example) at the outlet of the aerodynamic lens.

The outlet of the aerodynamic lens may directly open into the chamber in vacuo including the target surface (this is for example what is illustrated in FIG. 4). The distance between the outlet of the aerodynamic lens and the target surface is set to 200 mm.

It should be noted that alternatively, the outlet of the aerodynamic lens may open into an intermediate chamber, in vacuo, this intermediate chamber itself opening, for example by means of a debarker, into a vacuum deposition chamber including the target surface. This possibility is for example proposed in document FR 2 971 518.

Gold (Au) particles were first considered, with an average diameter of 35 nm. These particles are relatively dispersed and therefore do not form any aggregates. The outlet diaphragm 25 was then adjusted (FIG. 2, FIG. 3) for covering a wide range of values of its diameter.

A photograph of the deposits obtained on the target surface was then achieved. This is the object of FIG. 6.

For the value of the diameter d=3.2 mm of the outlet diaphragm 25, it may be considered that the jet of particles is collimated and that we are again found in a conventional situation as obtained with the aerodynamic lens of the prior art (FIG. 1).

For values of the diameter d of the diaphragm 25, less than below 3.2 mm, it is observed that the more the diameter d decreases and the more the impact surface of the gold particles is spread out on the target surface. The jet of particles from the aerodynamic lens is therefore increasingly divergent. For the case when d=2.6 mm, the spreading out is maximum, the diameter of the gold impact area on the target surface is of about 1 cm and the divergence half-angle has the value of about $\alpha$=25 mrads (this half-angle is then negative).

For values of the diameter d of the diaphragm 25 greater than 3.2 mm and up to 4 mm (last value tested experimentally), an increasingly low spreading out of the impact surface of the gold particles is observed on the target surface and therefore an increasingly significant collimation of the jet of particles.

Moreover, in every case, it is observed that the deposition of the gold particles on the target surface is homogeneous. This is particularly advantageous for achieving a homogeneous deposition over large surfaces, for example for producing a surface coating.

Another test was conducted under the same conditions with silicon particles. These particles had an average diameter of 10 nm, but appeared as aggregates for which the size was comprised between 50 nm and 150 nm.

The same type of observations as those of FIG. 6 was able to be carried out.

These experimental tests therefore show the possibility of applying the method of the invention.

Moreover, in addition to these experimental tests, a certain number of numerical simulations were carried out, on the basis of the aerodynamic lens 100 illustrated in FIG. 2, in order to better define the different relevant parameters in the application of the method according to the invention, from among which:

- the type (density) and the size of the particles;
- the diameter of the outlet diaphragm 25 of the aerodynamic lens; and
- the pressure at the inlet of the aerodynamic lens.

For this purpose, the piece of software used is Flow EFD V5 from Mentor Graphics. This piece of software is actually capable of treating diphasic flows (here, a particle/carrier gas aerosol) and compressible flows. However, it should be noted that this piece of software does not allow the taking into account of the random behavior due to Brownian motion and which in practice induces a substantial effect on particles with a size of less than 30 nm. The Brownian motion has the effect of making a jet of particles more divergent. Also, in the simulation results shown hereafter, one should keep in mind that in reality, the jet of particles is then a little more divergent than the simulated jet of particles, and this all the more since the size of the particles is small.

All the calculations were carried out with argon (Ar) as a carrier gas for the particles.

First calculations were carried out with a diameter of the outlet diaphragm $d_s$=3.2 mm or $d_s$=3.4 mm, a pressure at the inlet of the aerodynamic lens of 4 mbars and an outlet of the aerodynamic lens in vacuo.

The goal is then to determine the influence of the type and of the size of the particles. For this purpose, gold particles (Au; density 19.3 g/cm$^3$) of a size of 10 nm, silicon particles (Si; density of 2.33 g/cm$^3$) with a size of 50 nm and polystyrene particles (density 1.06 g/cm$^3$) of size 100 nm were simulated.

Figure 7B:
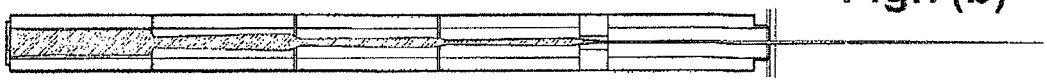
Figure 7C:
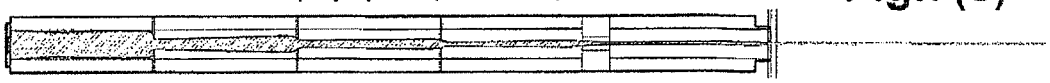

The results are illustrated in FIG. 7, which comprises FIG. 7(*a*) (Au, 10 nm), FIG. 7(*b*) (Si, 50 nm) and FIG. 7(*c*) (polystyrene, 100 nm).

On the whole of these figures, it is seen that the conditions of a collimated jet are obtained. Accordingly, the type and the size of the particles do not seem to modify qualitatively, what was shown with the experimental tests.

Nevertheless, these figures represent optimum collimation conditions (excellent collimation and Stokes number close to one). Therefore it is seen, quantitatively, that the optimum diameter of the outlet diaphragm of the aerodynamic lens depends on the type and on the size of the relevant particles (for gold in 10 nm, this is 3.4 mm; the value being slightly less in the other simulated cases).

This has a real interest since it shows that with the invention, it is possible to obtain a collimation for a wide spectrum of the type and of the size of the relevant particles.

Second calculations were conducted for the same particles (Au in 10 nm; Si in 50 nm and polystyrene in 100 nm) and a same pressure at the inlet of the aerodynamic lens of 4 mbars, as compared with the conditions of the first calculations.

However, the diameter of the diaphragm 25 was modified and set to $d_s$=2.2 mm, i.e. to a smaller value than for the first calculations.

Figure 8A:
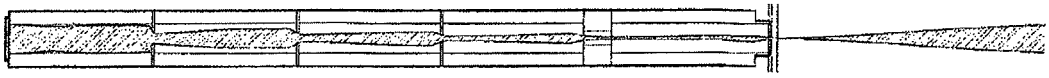
FIG. 8, which comprises FIGS. 8(*a*) to 8(*c*), provides simulation results, for conditions of a divergent jet of particles.
Figure 8B:
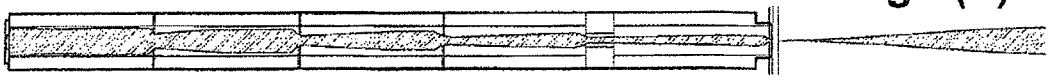
Figure 8C:
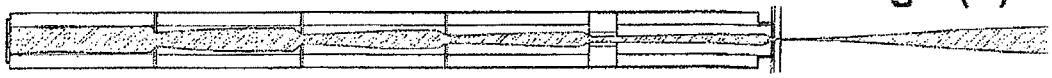

The results are illustrated in FIG. 8, which comprises FIG. 8(*a*) (Au, 10 nm), FIG. 8(*b*) (Si, 50 nm) and FIG. 8(*c*) (polystyrene, 100 nm).

On the whole of these FIGS. 8(*a*) to 8(*c*), it is seen that the conditions of a divergent jet with a negative divergence half-angle are obtained. Accordingly, the type and the size of the particles do not appear qualitatively, to modify what was shown with the experimental tests.

Nevertheless, these second calculations show according to the type and to the size of the particles, that the divergence half-angle is comprised between 45 mrad and 60 mrad. Thus, it is ascertained quantitatively that the type and the size of the relevant particles have an influence on the divergence half-angle of the jet of particles.

In return this therefore means that it is possible with the invention to define a given divergence half-angle regardless of the type and of the size of particles, by adjusting the diameter of the outlet diaphragm of the aerodynamic lens. Thus in the case of an application to a deposition of particles on a target surface, it is possible to handle thereby the extent of the impact area of the particles on the target surface, without modifying the distance between the outlet diaphragm of the aerodynamic lens and the target surface. Of course, another option is to modify this distance between the outlet diaphragm of the aerodynamic lens and the target surface.

Other simulations were carried out in order to determine, in a more general way, the time-dependent change of the divergence half-angle according to the diameter of the outlet diaphragm. In every case, the pressure at the inlet of the aerodynamic lens is maintained to 4 mbars, the outlet of the aerodynamic lens being in vacuo.

Figure 9A:
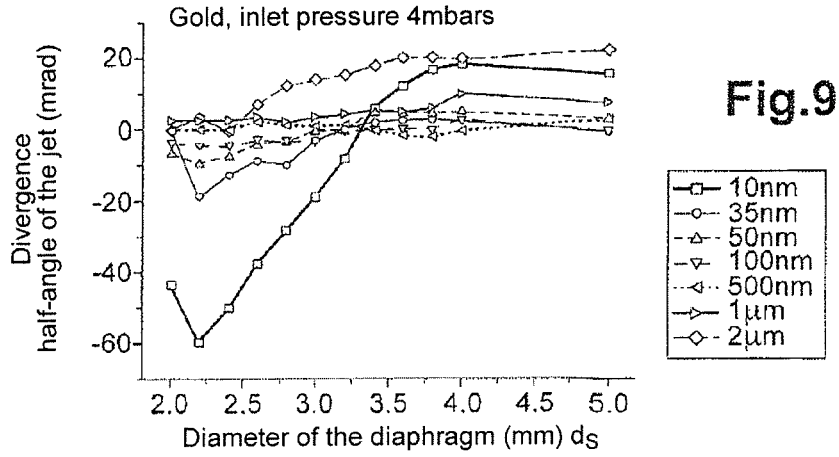
FIG. 9, which comprises FIGS. 9(*a*) to 9(*c*), based on simulation results, provides the time-dependent change in the divergence of the jet of particles depending on the diameter of the diaphragm used at the outlet of this lens.
Figure 9B:
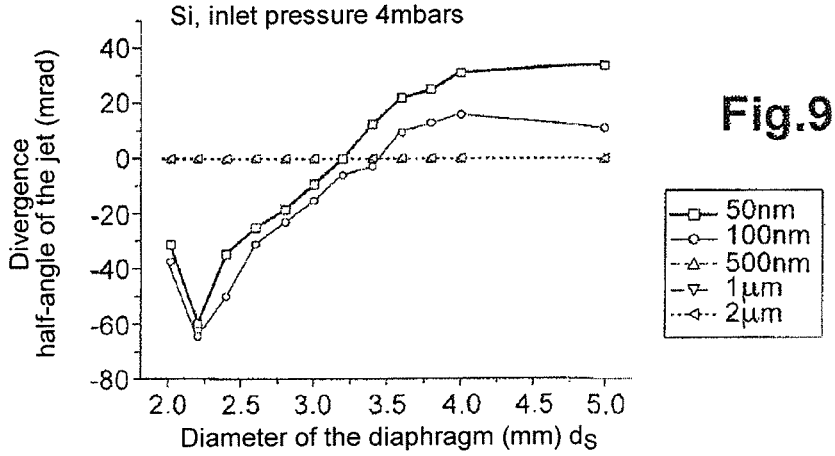
Figure 9C:
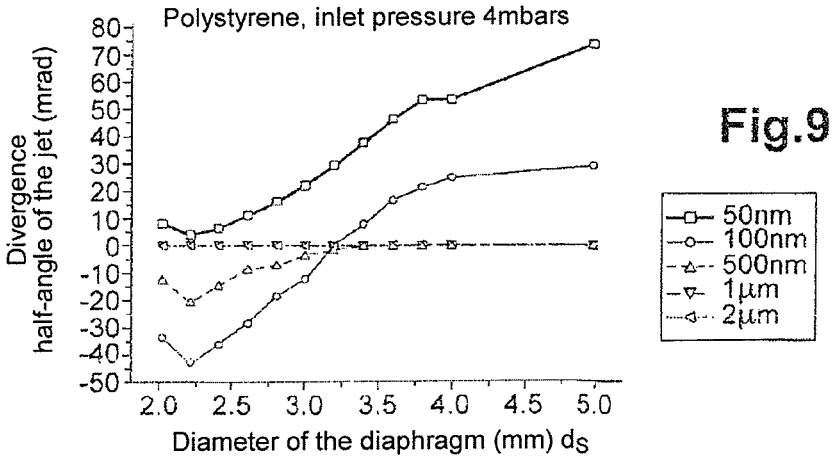

The results of these simulations are illustrated in FIG. 9, which comprises FIGS. 9(*a*) to 9(*c*). More specifically, FIG. 9(*a*) deals with gold (Au), according to sizes comprised between 10 nm and 2 microns. FIG. 9(*b*) deals with silicon (Si), according to sizes comprised between 50 nm and 2 microns. FIG. 9(*c*) deals with polystyrene, according to sizes comprised between 50 nm and 2 microns.

Regardless of the type of relevant particles, first of all it should be noted that the particles were simulated over a very wide size range, widened relatively to the size ranges targeted by an aerodynamic lens of the prior art (for example, FIG. 1) and these simulations show that the adjustment of the outlet diaphragm gives the possibility of actually controlling the divergence of the jet of particles at the outlet of the aerodynamic lens.

Moreover and generally, FIGS. 9(*a*) to 9(*c*) show that the best means for controlling the divergence of the jet of particles at the outlet of the aerodynamic lens is to decrease the value of the diameter of the outlet diaphragm of this lens from the value giving the possibility of obtaining an optimally collimated jet, therefore promoting a negative divergence half-angle (configuration of FIG. 5(*b*)).

However, in certain cases, for example for the polystyrene particles of 50 nm, a diameter value of the outlet diaphragm greater than the value giving the possibility of obtaining an optimally collimated jet may be necessary for obtaining a well-controlled divergent jet. In this case, the divergence half-angle is positive (configuration of FIG. 5(*c*)).

Under the simulation conditions having resulted in FIGS. 9(*a*) to 9(*c*), the transmission of the jet of particles was also evaluated.

Figure 10A:
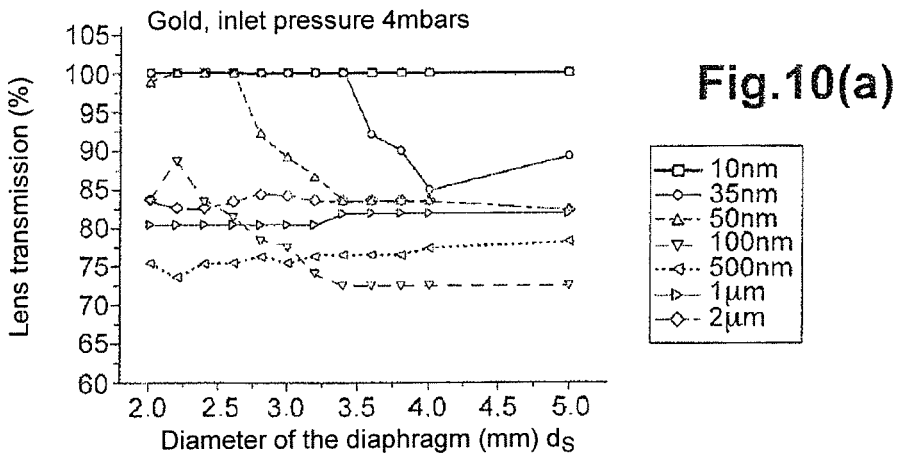
FIG. 10, which comprises FIGS. 10(*a*) to 10(*c*), based on simulation results carried out under the same conditions as those resulting in the simulation results discussed in FIG. 9, provides the time-dependent change in the transmission of the jet of particles through the aerodynamic lens depending on the diameter of the diaphragm used at the outlet of this lens.
Figure 10B:
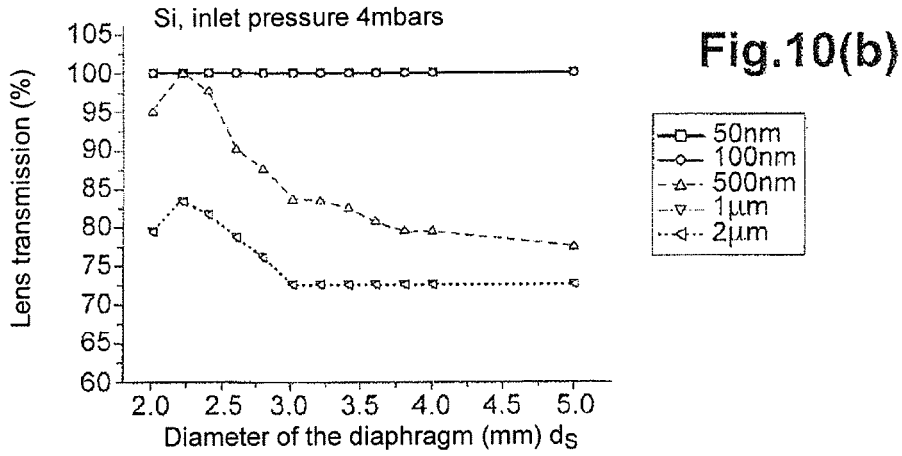
Figure 10C:
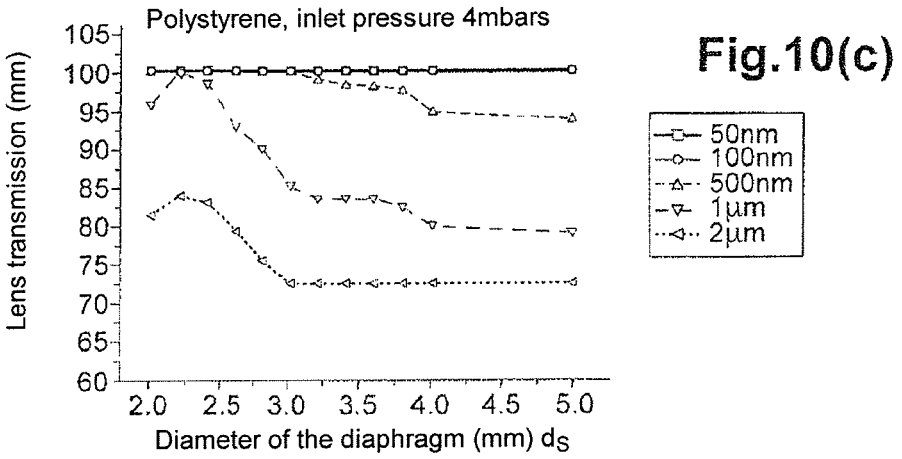

Thus, FIG. 10 provides the time-dependent change in the transmission level versus the diameter of the outlet diaphragm of the aerodynamic lens. More specifically, FIG. 10(*a*) deals with gold (Au), according to sizes comprised between 10 nm and 2 microns. FIG. 10(*b*) deals with silicon (Si), according to sizes comprised between 50 nm and 2 microns. FIG. 10(*c*) deals with polystyrene, according to sizes comprised between 50 nm and 2 microns.

In the preceding experimental tests and simulations, the pressure at the inlet of the aerodynamic lens was set to 4 mbars.

The same simulation campaigns were therefore carried out for a pressure at the inlet of the aerodynamic lens of 3 mbars on the one hand and of 5 mbars on the other hand. The applicants realize that this had an influence on the maximum value of the divergence half-angle which may be obtained. The applicants also realize that decrease or increase in the pressure at the inlet of the aerodynamic lens, relatively to a reference of 4 mbars, decreased this maximum value. Generally, the results were however of a same nature.

Also, in order to apply the method, it is possible to contemplate an inlet pressure comprised between 2 mbars and 5 mbars, preferably between 3 mbars and 5 mbars and advantageously 4 mbars.

Moreover it should be noted that the preceding experimental tests and simulations show that the control of the divergence of the jet may be carried out by only adjusting the diameter of the outlet diaphragm 25, since the other diaphragms remain with a set diameter.

In the preceding description, we were based on an aerodynamic lens (FIG. 2) notably including five chambers and therefore as many diaphragms other than the outlet diaphragm, with particular dimensions.

Nevertheless, the method according to the invention may quite be applied with any type of existing aerodynamic lens, however by providing an outlet diaphragm for which the diameter is adjustable.

By reducing the number of diaphragms within the aerodynamic lens, the possibilities of obtaining a collimated jet are reduced to a certain type (density) of particles and to a certain size of particles.

Nevertheless, the possibilities of obtaining a strongly divergent jet of particles are increased for a certain types of particles and sizes of particles. Thus, it is possible to obtain a greater maximum divergence half-angle with an aerodynamic lens such as the one which is illustrated in FIG. 2, moreover in a more extended range of particle sizes, in particular towards the large sizes and this for equivalent particle densities or further, for dense particles with similar sizes.

This may therefore have a benefit for certain applications, for example when it is desired to carry out a homogeneous deposition of particles over large surfaces.

FIG. 11 shows such a possibility, where two chambers CH1, CH2 and three diaphragms 20 (inlet diaphragm), 25 (outlet diaphragm) and 24 (diaphragm separating both chambers CH1, CH2) are observed. In this FIG. 11, the outlet diaphragm 25 has an adjustable diameter, the diaphragm 24 is not removable and has a given diameter, which is not adjustable.

Finally, the inlet diaphragm 20 has a given diameter and may notably, as illustrated in FIG. 11, be moreover not removable and have a non-adjustable diameter. In the latter case, the outlet diaphragm 25 is the sole diaphragm of the aerodynamic lens which has an adjustable diameter.

Moreover and regardless of the number of chambers provided within the aerodynamic lens, simulations have shown that, in addition to the adjustment of the diameter $d_s$ of the outlet diaphragm, the use of a diaphragm 24 (FIG. 2) of a smaller thickness than the one which is considered in the prior art of FIG. 1 (10 mm) had a positive impact on the control of the divergence of particles of great sizes, typically close to one micron and/or of great density.

Under certain conditions it may therefore be beneficial to provide a diaphragm 24 of small thickness e, for example between 0.2 mm and 5 mm, between 0.2 mm and 3 mm, between 0.2 mm and 2 mm or further between 0.2 mm and 1.5 mm.

In fact, the applicant therefore showed that the thickness e of the inlet diaphragm of the chamber including said outlet diaphragm 25 of the aerodynamic lens 100 might have a positive impact on the control of the divergence of the jet of particles.

In the foregoing description, we were based on an embodiment (FIG. 2) for which the diameters of (FIG. 11) and of each diaphragm (FIG. 2) other than the outlet diaphragm of the aerodynamic lens was increasingly smaller from the inlet of the aerodynamic lens towards its outlet.

This is only an example.

Indeed aerodynamic lenses exist where this feature is not observed.

The invention, consisting of being able to adjust the diameter of the outlet diaphragm of the aerodynamic lens, is therefore also applied in this case.

Moreover, always in the preceding description, we have shown a case when the outlet diaphragm 25 of the aerodynamic lens includes an iris with an adjustable diameter which may be adjusted manually.

Alternatively, it is possible to automate the system, by connecting the iris-shaped diaphragm 25 to a motor MOT, on which the outlet diaphragm 25 is mounted, this MOT motor being controlled by an external controller C, i.e. not belonging to the diaphragm 25.

This possibility is schematized in FIG. 12.

According to another alternative, much simpler to apply industrially, it is possible to provide, in the place of the aerodynamic lens 100, an assembly including an aerodynamic lens 100' comprising:

- n chambers 10 to 14, with n≥2, said chambers being separated from each other by a non-removable diaphragm and having a given diameter, which is not adjustable;
- a diaphragm, a so-called inlet diaphragm 20, intended to form an inlet of the aerodynamic lens for a jet of particles, said inlet diaphragm having a diameter; and
- another diaphragm, a so-called outlet diaphragm 25, intended to form an outlet of the aerodynamic lens for this jet of particles, said outlet diaphragm having a given diameter;

and wherein the outlet diaphragm 25 is removably mounted within the aerodynamic lens 100' and in that said assembly further comprises an additional diaphragm 25' having a diameter different from the one of the outlet diaphragm 25, said at least one additional diaphragm 25' being intended to be removably mounted in the aerodynamic lens instead and in place of said outlet diaphragm.

In this assembly, the outlet diaphragm does not appear as an iris, either controlled manually or not, for which the diameter $d_s$ is adjustable.

Indeed, the diameter of the outlet diaphragm is fixed. However, in so far that this outlet diaphragm is removably mounted within the aerodynamic lens, it may be changed at will from another set of diaphragms 25', 25", . . . , 25" having different diameters from each other.

Thus it is possible to carry out the adjustment of the diameter $d_s$ of the outlet diaphragm 25 quite simply by changing the diaphragm.

FIG. 13 is a representative diagram of such an assembly 200, including an aerodynamic lens 100' in which is housed, at the outlet of the aerodynamic lens and removably, an outlet diaphragm 25 and a set of diaphragms 25', 25", . . . , 25" (additional diaphragms) with diameters $d'_s$, $d''_s$, . . . , $d_s''$ different from each other and all different from the outlet diameter $d_s$ of the diaphragm 25 mounted on the aerodynamic lens 100'.

In order to produce a removable assembly, it is for example possible to modify the structure of the aerodynamic lens 100' at its outlet. For example, it is possible to mount a diaphragm on the end of the aerodynamic lens 100' by a mounting means MM such as screws, bolts, adhesive on the peripheral wall of the aerodynamic lens.

According to another possibility (not shown), it is possible to provide, on the aerodynamic lens 100', and at its end, a wall provided with a notch able to receive any of the diaphragms 25, 25', 25", . . . , 25".

The invention claimed is:

1. A method for controlling the divergence of a jet of particles in vacuo with an aerodynamic lens, the aerodynamic lens comprising:

- a diaphragm, a so-called inlet diaphragm, intended to form an inlet of the aerodynamic lens for a jet of particles, the inlet diaphragm having a given diameter ($d_1$);
- n chambers with n≥2, two successive chambers being separated from each other by a non-removable diaphragm and having a given diameter, which is not adjustable, the diameter of each diaphragm decreasing from the inlet of the aerodynamic lens; and
- another diaphragm, a so-called outlet diaphragm, intended to form an outlet of the aerodynamic lens for this jet of particles, the outlet diaphragm having an adjustable diameter;

the method including:

- a step for generating the jet of particles from the inlet to the outlet, in vacuo, of the aerodynamic lens; and
- a step for adjusting the diameter ($d_s$) of the outlet diaphragm to a value strictly less than the diameters of the diaphragms other than said outlet diaphragm for making the jet of particles divergent and for controlling the divergence of the jet of particles.

2. The method according to claim 1, wherein the aerodynamic lens includes n chambers, with n≥3, and therefore n diaphragms other than the outlet diaphragm, two successive chambers being separated from each other by a non-removable diaphragm and having a given diameter, which is not adjustable.

3. The method according to claim 1, wherein the inlet diaphragm is non-removable and has a non-adjustable diameter.

4. The method according to claim 1, wherein the pressure at the inlet of the aerodynamic lens is comprised between 2 mbars and 5 mbars.

5. A method for depositing, in vacuo, particles on a target surface, the method comprising providing an aerodynamic lens according to claim 4, and depositing, in vacuo, particles on a target surface.

6. The method according to claim 5, wherein the target surface has a surface area greater than or equal to one $cm^2$.

7. An aerodynamic lens for applying a method according to claim 1, comprising:

- a diaphragm, a so-called inlet diaphragm, intended to form an inlet of the aerodynamic lens for a jet of particles, the inlet diaphragm having a given diameter ($d_1$);
- n chambers with n≥2, two successive chambers being separated from each other by a non-removable diaphragm and having a given diameter, which is not adjustable, the diameter of each diaphragm decreasing from the inlet of the aerodynamic lens; and
- another diaphragm, a so-called outlet diaphragm, intended to form an outlet of the aerodynamic lens for this jet of particles;

wherein the outlet diaphragm has an adjustable diameter to a value strictly less than the diameters of the diaphragms other than said outlet diaphragm.

8. The aerodynamic lens according to claim 7, including n chambers, with n≥3, and therefore n diaphragms other than the outlet diaphragm, two successive chambers being separated from each other by a non-removable diaphragm and having a given diameter, which is not adjustable.

9. The aerodynamic lens according to claim 7, wherein the number n of chambers and therefore of diaphragms other than the outlet diaphragm is such that n≥5, two successive chambers being separated from each other by a non-removable diaphragm and having a given diameter, which is not adjustable.

10. The aerodynamic lens according to claim 7, wherein the inlet diaphragm is non-removable and has a non-adjustable diameter.

11. The aerodynamic lens according to claim 7, wherein the inlet diaphragm of the chamber including the outlet diaphragm of the aerodynamic lens has a thickness (e) comprised between 0.2 mm and 5 mm.

12. The aerodynamic lens according to claim 7, wherein the number n of chambers and therefore of diaphragms other than the outlet diaphragm is such that n≥5 and n≤15, two successive chambers being separated from each other by a non-removable diaphragm and having a given diameter, which is not adjustable.

13. The aerodynamic lens according to claim 7, further comprising a motor, wherein the outlet diaphragm is mounted on the motor which adjusts the diameter ($d_s$) of the outlet diaphragm using an external control.

14. An assembly for applying a method according to claim 1, including an aerodynamic lens comprising:

a diaphragm, a so-called inlet diaphragm, intended to form an inlet of the aerodynamic lens for a jet of particles, the inlet diaphragm having a given diameter ($d_1$);

n chambers with n≥2, two successive chambers being separated from each other by a non-removable diaphragm and having a given diameter, which is not adjustable, the diameter of each diaphragm decreasing from the inlet of the aerodynamic lens; and another diaphragm, a so-called outlet diaphragm, intended to form an outlet of the aerodynamic lens for this jet of particles, the outlet diaphragm having a given diameter with a value strictly less than the diameters of the diaphragms other than the outlet diaphragm;

wherein the outlet diaphragm is removably mounted within the aerodynamic lens and the assembly further comprises at least one additional diaphragm (25', 25", . . . , 25") having a diameter different from that of the outlet diaphragm, but with a value strictly less than the diameters of the diaphragms other than said outlet diaphragm, the at least one additional diaphragm being intended to be removably mounted in the aerodynamic lens instead and in place of the outlet diaphragm.

15. The assembly according to claim 14, wherein the aerodynamic lens includes n chambers, with n≥3, and therefore n diaphragms other than the outlet diaphragm, two successive chambers being separated from each other by a non-removable diaphragm and having a given diameter, which is not adjustable.

16. The assembly according to claim 14, wherein the number n of chambers and therefore of diaphragms other than the outlet diaphragm is such that n≥5, two successive chambers being separated from each other by a non-removable diaphragm and having a given diameter, which is not adjustable.

17. The assembly according to claim 14, wherein the inlet diaphragm is not removable and has a diameter which is not adjustable.

18. The assembly according to claim 14, wherein the inlet diaphragm of the chamber including the outlet diaphragm of the aerodynamic lens has a thickness (e) comprised between 0.2 mm and 5 mm.

19. The assembly according to claim 14, wherein the number n of chambers and therefore of diaphragms other than the outlet diaphragm is such that n≥5 and n≤15, two successive chambers being separated from each other by a non-removable diaphragm and having a given diameter, which is not adjustable.

* * * * *